US005349241A

United States Patent [19]

Gilmartin et al.

[11] Patent Number: 5,349,241

[45] Date of Patent: Sep. 20, 1994

[54] MULTIPLE POINT CONTROLLED FLASHING LOCATOR SYSTEM

[75] Inventors: Michael P. Gilmartin, Hamilton; Bryan W. Gilmartin; Frank J. Gilmartin, both of Cincinnati, all of Ohio

[73] Assignee: CPX Industries, Inc., Cincinnati, Ohio

[21] Appl. No.: 995,199

[22] Filed: Dec. 22, 1992

Related U.S. Application Data

[63] Continuation-in-part of Ser. No. 959,741, Oct. 13, 1992, abandoned.

[51] Int. Cl.[5] ..... G08B 5/00

[52] U.S. Cl. ..... 307/114; 307/125; 340/331; 361/189

[58] Field of Search ..... 307/356, 632, 113, 114, 307/125, 132 E, 139, 141, 141.4; 340/329, 331, 332; 315/200 A; 361/156, 195, 196, 197, 198, 203, 205, 189, 191

[56] References Cited

U.S. PATENT DOCUMENTS

| | | | |
|---|---|---|---|
| Re. 33,504 | 12/1990 | Yuhasz et al. | 307/115 |
| 2,082,789 | 6/1937 | Chase . | |
| 2,264,696 | 12/1941 | Jackson | 361/189 |
| 2,324,844 | 7/1943 | Hutt | 307/114 X |
| 2,888,669 | 5/1959 | Thomas et al. . | |
| 2,911,637 | 11/1959 | Wortmann . | |
| 2,983,812 | 5/1961 | Ashe . | |
| 3,047,773 | 7/1962 | Morton . | |
| 3,058,032 | 10/1962 | Woodward . | |
| 3,287,722 | 11/1966 | Craig . | |
| 3,599,201 | 8/1971 | Clardy et al. . | |
| 3,624,635 | 11/1971 | Less . | |
| 3,631,318 | 12/1971 | Hubbard . | |
| 3,725,834 | 4/1973 | Dorsey et al. . | |
| 3,728,713 | 4/1973 | Alten . | |
| 3,810,149 | 5/1974 | Miller et al. . | |
| 3,860,910 | 1/1975 | Hudson . | |
| 3,863,236 | 1/1975 | Clardy . | |
| 3,911,425 | 10/1975 | Muncheryan . | |
| 3,999,176 | 12/1976 | Kellogg et al. . | |
| 4,003,040 | 1/1977 | Browand . | |
| 4,074,244 | 2/1978 | Balderson . | |
| 4,177,408 | 12/1979 | Mason . | |
| 4,254,405 | 3/1981 | Wenzlaff . | |
| 4,276,542 | 6/1981 | Russ . | |
| 4,290,057 | 9/1981 | Knight . | |
| 4,479,170 | 10/1984 | Richardson . | |
| 4,499,453 | 2/1985 | Right . | |
| 4,547,761 | 10/1985 | Jones . | |
| 4,556,863 | 12/1985 | Devitt et al. . | |
| 4,570,155 | 2/1986 | Skarman et al. . | |
| 4,587,753 | 5/1986 | Harper . | |
| 4,611,265 | 9/1986 | Davis | 362/145 |
| 4,634,957 | 1/1987 | Hollaway . | |
| 4,642,477 | 2/1987 | Grzanowski et al. . | |
| 4,686,505 | 8/1987 | Vanderburg . | |
| 4,730,184 | 3/1988 | Bach . | |
| 4,739,187 | 4/1988 | Nelson et al. . | |
| 4,839,630 | 6/1989 | Miller . | |
| 4,855,723 | 8/1989 | Fritz et al. . | |
| 4,881,058 | 11/1989 | Berry, III . | |
| 4,901,461 | 2/1990 | Edwards et al. . | |
| 4,967,177 | 10/1990 | Nguyen . | |
| 4,983,960 | 1/1991 | Dunn . | |
| 5,070,327 | 12/1991 | Ellingson . | |
| 5,155,470 | 10/1992 | Tuttle . | |
| 5,180,925 | 1/1993 | Lieb | 307/114 |

OTHER PUBLICATIONS

Consumer Engineering Inc., Palm Bay Fla., date unknown.

Crisis-Lite (Brochure), Creative Products, Apollo Penna., date unknown.

*Primary Examiner*—A. D. Pellinen

*Assistant Examiner*—F. M. Fleming

*Attorney, Agent, or Firm*—Wood, Herron & Evans

[57] ABSTRACT

A multiple point controlled flashing locator system includes a control circuit responsive to activation of any one of a plurality of remotely located switches to override an on/off function of the outside light switch and to energize a flasher circuit to cause the outside light to flash on and off. An audible alert circuit may be provided to provide assurance to the user that the outside light is operating and by which to test the outside light at any time day or night and from any of a number of locations within the dwelling.

14 Claims, 1 Drawing Sheet

MULTIPLE POINT CONTROLLED FLASHING LOCATOR SYSTEM

This application is a continuation in part of application Ser. No. 07/959,741, filed Oct. 13, 1992 entitled "Flashing Locator Switch Control with Built-In Lamp Operation Test," the now abandoned, disclosure of which is incorporated by reference as if set forth fully herein.

BACKGROUND OF THE INVENTION

I. Field of the Invention

The present invention relates to flashing locator systems and more particularly to such systems useful for turning an outdoor light, for example, on, off or into a flashing mode, the latter for aiding others to quickly locate a particular dwelling, especially at night.

II. Description of the Prior Art

Oftentimes, an emergency distress call is made requiring that emergency medical, police, and/or fire personnel quickly locate a particular dwelling where help is needed. To find that dwelling, the emergency personnel must typically try to locate a specific address number. Oftentimes the number is not easily visible from the street so help is delayed. When such calls are made at night, there may be even greater difficulty in locating the correct address.

To overcome such problems, it has been proposed to replace the existing two-position (on/off) switch which is conventionally employed from inside the home such as by the front door to turn the outside light (such as a lamppost light, for example) on and off with a three-position flashing locator system. Such a system includes a flasher circuit such that in addition to being able to turn the light on and off in conventional manner, the switch includes a third "flashing mode" position which activates the flasher circuit to cause the outside light to repeatedly flash on and off. As they travel down the street looking for the correct address, the emergency personnel responding to the scene may have their attention drawn immediately to the flashing light and thus have a better chance to locate the correct dwelling in a hurry. But there are a couple of drawbacks with previously proposed flashing locator systems.

It will be appreciated that those who may have need to place the system in the flashing mode may be in a state of panic and perhaps in a state of diminished capacity, both physically and emotionally. As a consequence, such individuals may not be able to get to the switch at the front door to place the system into the flashing mode. Additionally, it becomes important to such individuals to know that help is on the way. Unfortunately, the individual may not be in a position to readily see or perceive that the light has begun flashing. Or, in some cases, the outside light may simply not be situated where it can be readily seen from the vicinity of the switch. In either event, the individual may not know for sure that the system has been activated and thus may feel greater panic and aggravate the situation.

Still further, many users of such flashing locator systems need to know the system is fully operational in the event its use is needed. Thus, it is important to know that the outside light is not burnt out, for example. One way of testing whether the light is working might involve simply turning the outside light on and looking to see if it is lit. If the light is difficult to see due to its positioning, such a visual test is hardly satisfactory and may even prove unduly difficult. Indeed, it is typical to perform such a test during the daytime when it is easier, and safer, to go outside to view the light to see if it is lit, and/or to change the bulb if it is not working. But, obviously, testing in the daytime makes viewing the light that much more difficult since it is difficult to determine whether the bulb is actually on.

SUMMARY OF THE INVENTION

The present invention provides a flashing locator system that overcomes such drawbacks. More specifically, the present invention permits the system to be placed into the flashing mode from one or more locations remote from the front door switch. To this end, and in accordance with one aspect of the invention, there are provided one or more switches distributed throughout the dwelling and remote from the main flashing locator switch, but which are interconnected therewith through a control circuit in such a manner that the system may be placed into the flashing mode by not only the main switch but by activation of any one of the remote switches as well irrespective of whether the light has been turned on at the main switch. In this way, if an individual is in the bedroom, for example, and a fire breaks out, activation of the remote switch in the bedroom will place the system in the flashing mode without the need for the individual to waste the time, or take the risk, of trying to locate the flashing locator switch at the front door.

In accordance with another feature of the present invention, there is provided a mechanism by which to immediately assure the user that the flashing mode has been entered into and, further, to provide a way, from inside the dwelling, without even seeing the outside light and at any time desired, to quickly and easily test whether the outdoor light is operating. To this end, and in accordance with this further aspect of the present invention, the flashing locator system is provided with a buzzer circuit in series with the outdoor light but placed inside the dwelling such as in association with the main control switch inside the dwelling, which buzzer sounds only when the system is in the flashing mode and the outdoor light is actively drawing current (such as occurs when the bulb filament is intact and can light up). Thus, when it becomes necessary to place the system in the flashing mode for others to be able to locate the dwelling, there is the immediate and certain psychological assurance that help is on the way when the buzzer sound emanates from the area of the switch. Additionally, the operability of the outdoor light may be quickly and easily tested by briefly placing the system in the flashing mode from multiple locations in the dwelling. If the buzzer sounds, the light may be safely assumed to be working whereas if the buzzer does not sound, the bulb is probably burned out. This test may be done at any time, day or night, and irrespective of whether the user can even see the light from where the user stands to place the system in the flashing mode.

By virtue of the foregoing there is thus provided a multiple point controlled flashing locator system which overcomes the above-described drawbacks of previously proposed flashing locator systems.

These and other objects and advantages of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE DRAWINGS

Figure 1:
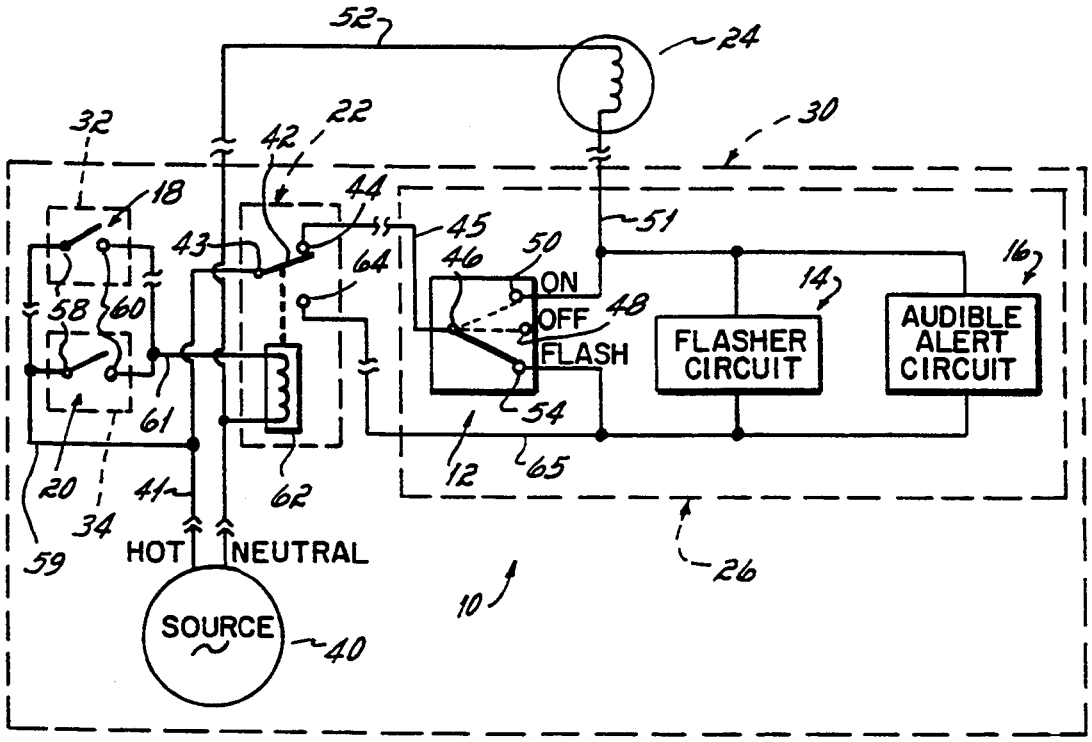
FIG. 1 is a schematic block diagram of one embodiment of a multiple point controlled flashing locator system according to the principles of the present invention.

With reference to FIG. 1, there is shown an embodiment of a multiple point controlled flashing locator system 10 comprising three-position control switch 12 (such as a 16-amp, 125 V.A.C. rated switch available from Carling Switch Co., Part No. RC-211-PS-0N, or Arrow-Hart-Eaton, Inc., Part No. 1604-22E), flasher circuit 14, audible alert circuit 16, and remote control switches 18 and 20 electrically interconnected through control circuit 22 (such as a relay available from Aromat, Inc. part no. AP5127) to control turning outside light 24 on and off or into a flashing mode as will be described. Switch 12 is typically a substitute for the regular outdoor light switch and may be associated with circuits 14 and 16 in the same housing and placed near an exit such as by a front door (represented at 26) of a dwelling (represented at 30). Relay control circuit 22 may similarly be placed with switch 12 or anywhere else in dwelling 30 that is convenient or desirable.

Control switches 18 and 20 are typically located remote from switch 12 and are distributed throughout the dwelling in various rooms of house 30 such as in living room 32 and bedroom 34, respectively, by way of example. Switch 12 is typically utilized to turn outside light 24 on and off. To this end, AC power is normally provided from the hot side of AC power source 40 via wire 41, normally closed relay switch 42 of circuit 22 (via contacts 43 and 44 thereof), and wire 45 to input contact 46 of switch 12. When switch 12 is in the off position, i.e., with input contact 46 thereof electrically coupled to output contact 48, no power is provided through switch 12 to light 24 and light 24 is normally off. With switch 12 in the on position, i.e., with contact 46 electrically coupled to output contact 50, AC power may be coupled through switch 12 and via wire 51 to light 24 which is in series with wire 52 and the neutral side of source 40 thus turning light 24 on. Switch 12 has a third state, shown in solid line in FIG. 1, in which contact 46 is electrically coupled to output contact 54 to provide power to light 24 via parallel circuits 14 and 16 to cause light 24 to blink on and off and to emit an audible alert indication that the system is in the flash mode.

Multiple point control is provided by remote switches 18 and 20, each having an input contact 58 coupled via wire(s) 59 to the hot side of source 40 and output contacts 60 coupled via wire(s) 61 to one terminal of solenoid 62 of circuit 22. The other terminal of solenoid 62 is coupled to the neutral side of source 40. Closure of either of switches 18 or 20 couples AC power through solenoid 62 causing switch 42 to change state and electrically decouple contacts 43 and 44 and instead electrically couple contact 43 to contact 64. As a consequence, power is no longer coupled to input contact of switch 12 but is instead directed to circuits 14 and 16 via wire 65 to thereby bypass switch 12 (and disconnect power from light 24 via contact 50 if switch 12 is in the on state) and place system 10 directly into the flashing mode.

In use, main control switch 12 is located at front door 26 within dwelling 30, for example, and remote control switches 18 and 20 are located remote therefrom such as in living room 32 and bedroom 34, respectively. In normal use, the on and off positions of switch 12 are typically employed to turn light 24 on at night and off during the day, for example. In either position of switch 12, the flashing mode is not activated so circuits 14 and 16 are typically not energized. Anytime it is necessary to provide the ability to help others locate dwelling 30, such as when emergency personnel are responding, for example, either switch 12 may be placed in the flash position, or any of switches 18 or 20 may be activated, thereby coupling power to flasher circuit 14 to cause outside light 24 to flash on and off. Additionally, circuit 16 is energized to provide an audible alert to those in the vicinity of door 26 to thereby provide the desired assurance to the user that the light is flashing and help is on the way. Also, others nearby may hear the audible alert and come to the aid of the user.

Additionally, if light 24 is not functioning (e.g., it is burned out), current will not flow through audible alert circuit and no audible alert will be given. This feature allows the user to know that light 24 is burned out and thus needs to be replaced. As a consequence, light 24 may be easily and quickly tested at any time, day or night, and without regard to whether light 24 is even visible from the location of the user who may test the light from the location of any of switches 12, 18 or 20. More specifically, to test light 24, the user (not shown) places switch 12 in the flash position, or activates switch 18 or 20 to cause system 10 to be in the flash mode, and listens for the audible sound from audible alert circuit 16. If the sound is heard, then light 24 is presumed to be operating and switch 12 is placed back into the off position or switch 18 or 20 turned off. If no sound is heard, then light 24 is likely burned out and must be replaced. As the test of light 24 relies on sound within the dwelling such as at the location of switch 12, and not on visual sight of light 24, the foregoing test may be undertaken at any time and irrespective of whether light 24 is even visible from the location of switches 12, 18 or 20. Indeed, for safety's sake, the user need not open a door or step outside to see light 24 in order to have reasonable assurance that it is working.

Figure 2:
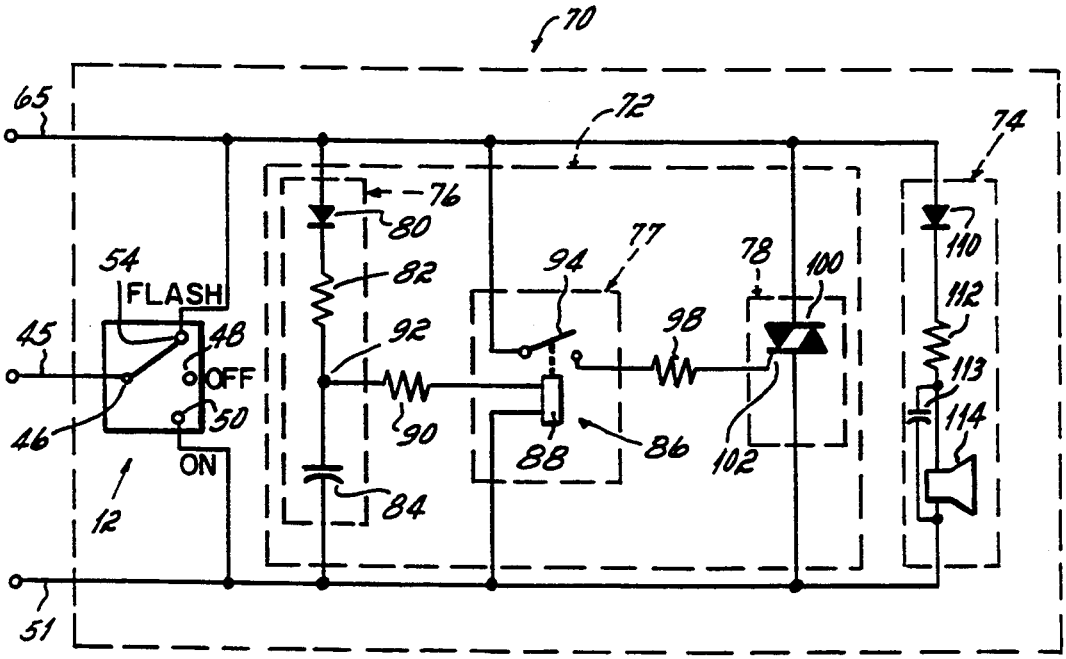
FIG. 2 is a schematic diagram of an alternative embodiment of a flasher circuit and audible alert circuit for the flashing locator system of FIG. 1.

With reference to FIG. 2, there is shown a schematic diagram of an alternative embodiment 70 of a flashing locator system for use in system 10. System 70 includes switch 12, flasher circuit 72 and buzzer circuit 74 with switch contact 54 indirectly connected to wire 51 through parallel circuits 72 and 74. Flasher circuit 72 includes three parallel circuit legs 76, 77, and 78 between contact 54 and wire 51. Circuit 76 is a flash timer circuit and includes in series diode 80, 4.7 kilohm (Kohm), $\frac{1}{4}$ watt, 5% resistor 82 and 100 microfarad capacitor 84. Leg 77 is a flash control leg and includes Reed relay 86 (part number MEH 31-1412 available from NAI, Inc. or part number LG400-112 available from Standex, Inc.), the solenoid 88 of which is connected in series with 4.7 Kohm, $\frac{1}{4}$ watt, 5% resistor 90 between node 92 of resistor 82 and capacitor 84 in timer leg 76 and wire 51 by which to open and close relay switch 94. Relay switch 94 is connected between switch contact 54 and 1 Kohm, ¼ watt, 5% resistor 98 to provide power to lamp switch leg 78 when switch 94 is closed as will be described. Third leg 78 includes triac 100 (such as Part No. Q4004L4, available from Teccor Corp. or Power-X Corp.) which is gated on by AC voltage at its gate input 102 from resistor 98 under control of flash control leg 77. System 70 further includes buzzer circuit 74 comprised of the series circuit of diode 110, 10 Kohm, ½ watt, 5% resistor 112 and the parallel combination of 33 microfarad capacitor 113 and buzzer 114 (such as Part No. TMB12 available from Star Micronics, Inc., or Part No. AI165 or AI155 available from Projects Unlimited, Inc.) which sounds in response to current flowing through circuit 74 which occurs only when switch 12 is in the flash position and light 24 is not burned out.

With switch 12 in the flash position, AC current flows through contact 54 and is half-wave rectified by diode 80 to charge up capacitor 84 at a rate determined by the RC time constant of resistors 82 and 90 and capacitor 84. When capacitor 84 is sufficiently charged such that current flow through solenoid 88 is large enough to pull in normally open switch 94 (and thus close same), AC voltage will be coupled from contact 54 to the gate input 102 of triac 100. That input voltage will cause triac 100 to close like a switch allowing AC current to flow directly from contact 54 into wire 51 to turn light 24 on. While triac 100 is closed, there is, in effect, a short circuit across timer leg 76 such that capacitor 84 is no longer being charged but instead discharges through resistor 90 and solenoid 88 until such time as there is too little current flowing through solenoid 88 to hold relay switch 94 closed. At that time, solenoid 88 will release its pull and allow switch 94 to open, causing triac 100 to lose input voltage at gate 102 such that triac 100 will thereafter shut off or open and cause light 24 to go off (or at least to reduce substantially in intensity since current through buzzer circuit 74 may still at least warm the filament of light 24). Light 24 will be off until capacitor 84 is again charged and the above process will repeat to then cause light 24 to repeatedly flash on and off.

Similarly, AC current is coupled to buzzer circuit 74 and is half-wave rectified by diode 110 to thus cause buzzer 114 to sound. During those times that triac 110 is on, circuit 74 will be effectively short-circuited such that insufficient current flows through buzzer 114 to allow it to sound (or it may sound at a very low and barely audible level). The result is to desirably provide an intermittent buzzer sound so as to "flash" like light 24. Typically, when light 24 is on, buzzer 114 is off and vice versa.

By virtue of the foregoing, there is thus provided a flashing locator system which advantageously may be controlled from multiple locations and which further provides an audible indicator within the dwelling for the dual purpose of providing assurance that help is on the way and to provide a quick and easy way to test whether the outside light is burned out.

While the present invention has been illustrated by the description of embodiments thereof, and while the embodiments have been described in considerable detail, it is not the intention of applicants to restrict or in any way limit the scope of the appended claims to such detail. Additional advantages and modifications will readily appear to those skilled in the art. For example, only one, or more than two, remote switches could be employed. Also, switch 12 could be replaced with a standard two position on/off switch and the flash mode controlled only by remote switches 18 or 20 (with or without an additional remote control switch at the front door location, for example, for selectively energizing control circuit 22 to engage the flash mode). Additionally, the audible alert could be eliminated or placed elsewhere than with main control switch 12. Alternative control circuits could also be devised such as all solid state circuits or multiple relay controls as will be readily appreciated by those skilled in the art. Additionally, a light could also be provided with the switch system to indicate that the flash mode has been engaged. The invention in its broader aspects is therefore not limited to the specific details, representative apparatus and method, and illustrative examples shown and described. Accordingly, departures may be made from such details without departing from the spirit or scope of applicants' general inventive concept.

What is claimed is:

1. A method of providing multiple point control of a flashing locator system comprising:

providing a main switch having an input and at least two selectable output positions including an on position and a flash position, and providing a flasher circuit coupled to said main switch to be interconnected to a source of power and a light outside a dwelling when the main switch is in the flash position, the flasher circuit, when so interconnected, causing the outside light to repeatedly flash on and off;

providing a control circuit having a power input coupled to the source of power and at least two power outputs, a first of the power outputs being coupled to the main switch input and a second of the power outputs coupled to the flasher circuit, the control circuit having a first state in which the power input is coupled to the first power output whereby to provide power from the power source to the main switch and a second state in which the power input is coupled to the second power output whereby to provide power from the power source directly to the flasher circuit bypassing the main switch;

coupling a plurality of remote switches, each at a respective location within the dwelling, to the control circuit; and bypassing the main switch and causing the flasher circuit to be so interconnected directly to the power source by placing the control circuit in the second state in response to actuation of any one of the remote switches to flash the outside light from remote locations regardless of the position of the main switch.

2. The method of claim 1 further comprising actuating one of the remote switches.

3. The method of claim 1 further comprising:

generating an audible alert sound when the flasher is interconnected to the source of power.

4. The method of claim 3 further comprising generating the audible alert sound within the dwelling.

5. A method of testing a light bulb in an outside light socket located outside a dwelling from inside a dwelling comprising:

providing a main switch having an input and at least two selectable output positions including an on position and a flash position;

providing an audible alert circuit to be selectively interconnected within the dwelling to a source of power through the main switch when the main switch is in the flash position, the audible alert circuit being interconnected to an outside light socket such that when the audible circuit is connected to the power source, current flows through the audible alert circuit and through the outside light socket to emit an audible alert sound in the dwelling and illuminate an outside light bulb in the socket if the outside light bulb is not burned out and there is no open circuit preventing current from flowing through the audible alert circuit;

coupling a control circuit to the main switch and the audible alert circuit, the control switch having a power input coupled to the power source and at least two power outputs, a first of the power outputs being coupled to the main switch input and a second of the power outputs being coupled to the audible alert circuit, the control circuit having a first state in which the power input is coupled to the first power output whereby to provide power from the power source to the main switch and a second state in which the power input is coupled to the second power output whereby to provide power from the power source directly to the audible alert circuit bypassing the main switch;

coupling a plurality of remote switches, each at a different location within the dwelling, to the control circuit;

bypassing the main switch and causing the audible alert circuit to be so interconnected directly to the power source by placing the control circuit in the second state in response to actuation of any one of the remote switches such that the audible alert sounds and the light bulb is illuminated regardless of the position of the main switch; and after actuating any one of the remote switches, listening for the audible alert sound absence of which indicates that the outside light may have burned out resulting in an open circuit preventing current from flowing through the audible circuit.

6. A multiple point controlled flashing locator system comprising:

a main switch having an input and at least two outputs, the main switch having an off position in which the outputs are disconnected from the input, an on position in which a first of the outputs is coupled to the input, and a flash position in which a second of the outputs is coupled to the input;

a flasher circuit coupled to the main switch second output to receive power from the main switch input when the main switch is in the flash position;

a control circuit having a power input and at least two power outputs a first of which is coupled to the main switch input and a second of which is coupled to the flasher circuit, the control circuit having a first state in which the power input is coupled to the first power output whereby to provide power to the main switch and a second state in which the power input is coupled to the second power output whereby to provide power to the flasher circuit and bypass the main switch; and at least one remote switch coupled to the control circuit and being actuatable to cause the control circuit to be in the second state whereby the flasher circuit may be powered to cause an outside light connected to the system to flash on and off in the event that either the main switch is in the flash position or the remote switch is actuated regardless of the position of the main switch.

7. The multiple point controlled flashing locator system of claim 6 further comprising additional remote switches coupled to the control circuit each being independently and selectively actuatable to cause the control circuit to be in the second state to power the flasher circuit directly.

8. The multiple point controlled flashing locator system of claim 6, the control circuit including a relay solenoid and a relay switch having a switch input coupled to the power input and at least two switch outputs coupled to respective ones of the power outputs to thereby couple to the main switch and the flasher circuit respectively, the switch coupling its switch input to a first switch output in the first state of the control circuit and being responsive to energization of the relay solenoid to switch the control circuit to the second state whereby to couple its switch input to a second switch output, the relay solenoid being energized upon actuation of the remote switch so as to cause the relay switch input to couple to the second switch output and directly energize the flasher circuit bypassing the main switch.

9. The multiple point controlled flashing locator system of claim 8 further comprising additional remote switches coupled to the control circuit each being independently and selectively actuatable to energize the relay solenoid and move the relay switch to the second state.

10. The multiple point controlled flashing locator system of claim 6 further comprising an audible alert circuit being coupled in series between the main switch and the outside light to receive power through the main switch in the flash position thereof and being coupled in a series between the control circuit and the outside light to receive power through the control circuit when the control circuit is in the second state, the audible alert circuit generating an audible alert sound when it receives power and the outside light is operable whereby if the outside light is burned out, the audible alert circuit will not sound.

11. The multiple point controlled flashing locator system of claim 10, the flasher circuit and the audible alert circuit being in parallel.

12. The multiple point controlled flashing locator system of claim 6 wherein the on position of the main switch couples power to the outside light whereby to turn the light on when the control circuit is in the first state, the on position of the main switch being ineffective in the second state of the control circuit when said main switch is bypassed.

13. A multiple point controlled system located within a dwelling for testing a light outside the dwelling, the system comprising:

a main switch having an input and at least two outputs with a flash position where the input is coupled to one of the outputs;

a plurality of remote switches distributed within the dwelling;

audible alert circuit means for generating an audible alert sound when current flows therethrough, the audible alert circuit means being coupled to a power source through the main switch when the main switch is in the flash position and being coupled in series with the outside light to generate sound when the light is on;

a control circuit having a power input and at least two power outputs one of which is coupled to the main switch input to supply power to the main switch when the control circuit is in a first state, the control circuit, in a second state, coupling the other power output directly to the audible alert circuit means and bypassing th main switch, the control circuit being coupled to one of the remote switches so as to be in the second state in response to actuation of any one of the remote switches whereby absence of a sound from the audible alert circuit means in response to actuation of a said remote switch is indicative that the outside light may have burned out.

14. The multiple point controlled system of claim 13, the audible alert circuit means being positioned within the dwelling such that the outside light may be tested from inside of the dwelling.

* * * * *